US005577549A

United States Patent [19]

Phillips et al.

[11] Patent Number: 5,577,549

[45] Date of Patent: *Nov. 26, 1996

[54] MOLD FLUXES USED IN THE CONTINUOUS CASTING OF STEEL

[75] Inventors: Royston J. Phillips, Strongsville; Spencer C. Diehl, North Olmsted, both of Ohio

[73] Assignee: Foseco International Limited, Birmingham, England

[ * ] Notice: The term of this patent shall not extend beyond the expiration date of Pat. No. 5,538,070.

[21] Appl. No.: 421,151

[22] Filed: Apr. 10, 1995

Related U.S. Application Data

[63] Continuation-in-part of Ser. No. 411,651, filed as PCT/GB94/01781 Aug. 15, 1994, Pat. No. 5,538,070.

[51] Int. Cl.[6] ..... C21C 7/076

[52] U.S. Cl. ..... 164/473; 148/26; 75/305

[58] Field of Search ..... 164/473, 472; 148/23, 26; 75/305, 327, 329, 309, 310

[56] References Cited

U.S. PATENT DOCUMENTS

| | | | |
|---|---|---|---|
| 4,221,595 | 9/1980 | Zebrowski | 106/56 |
| 4,321,154 | 3/1982 | Ledru | 252/62 |
| 4,561,912 | 12/1985 | Courtenay et al. . | |
| 4,785,872 | 11/1988 | Koul et al. | 164/56.1 |
| 5,240,492 | 8/1993 | Phillips et al. | 75/305 |

FOREIGN PATENT DOCUMENTS

| | | |
|---|---|---|
| 510842 | 10/1992 | European Pat. Off. . |
| 233378 | 6/1985 | Germany . |
| 246260 | 6/1987 | Germany . |
| 277856 | 4/1990 | Germany . |
| 54-122634 | 9/1979 | Japan . |
| 59-7466 | 1/1984 | Japan . |
| 1514185 | 6/1978 | United Kingdom . |

OTHER PUBLICATIONS

The Making shaping and treating of Steel, USS ed by McGannon (1971) pp. 240–243.

*Primary Examiner*—Joseph J. Hail, III
*Assistant Examiner*—Randolph S. Herrick
*Attorney, Agent, or Firm*—Nixon & Vanderhye P.C.

[57] ABSTRACT

A mold flux for the continuous casting of steel (including ultra low carbon steel) comprises refractory metal oxide, at least one fluxing agent, a binder, and expandable graphite in the amount of 0.3–1.0% by weight, the expandable graphite having a size less than about 80 mesh, and the flux in the form of spherical granules 200–500 microns in diameter. The binder typically comprises between about 8–14% weight soda ash, or between about 4–7% by weight lithium carbonate, or a combination of soda ash and lithium carbonate wherein double the percentage of lithium carbonate plus the percentage of soda ash is between about 8–14%. The flux may additionally include—especially where ultra low carbon steel is being continuously cast—starch and $MnO_2$ to reduce slag rim, improve thermal insulation, and reduce carbon pickup.

16 Claims, No Drawings

MOLD FLUXES USED IN THE CONTINUOUS CASTING OF STEEL

CROSS REFERENCE TO RELATED APPLICATION

This application is a continuation-in-part of U.S. patent application Ser. No. 08/411,651 filed Apr. 5, 1995, now U.S. Pat. No. 5,538,070, which is the U.S. National Phase of PCT/GB94/01781 filed Aug. 15, 1994.

BACKGROUND AND SUMMARY OF THE INVENTION

This invention relates to mold fluxes and their use in the continuous casting of steel.

In the continuous casting of steel a mold flux is generally added to the surface of the molten steel in the mold. The flux provides lubrication between the mold wall and the steel, it reduces the loss of heat from the surface of the steel, it protects the surface from oxidation, and it may remove impurities such as alumina from the steel.

As granules evolve much less dust compared with powder, mold fluxes used in the continuous casting of steel are often used in the form of granules, which may be produced by, for example, spray-drying of the flux constituents. The excellent flowability of granules makes them particularly suitable for automatic feeding to the mold, for example, using a DAPSOL® feeder. However once the flux is in the mold the flowability of the granules becomes a disadvantage since the granules tend to find their own level under high rates of flow of steel into the mold and the surface of the steel may become exposed in the corners of the mold.

It has now been found that the above problem can be alleviated if the granules contain a minor amount of an expandable material which will expand under the action of heat and will cause the granules to break down into powder on the surface of the steel. According to the invention it has also been found that spherical granules yield the best results, and that the expandable material (particularly acid treated graphite) should have a particular size, and utilize particular binders, in order to obtain the best results. Also, it has been recognized according to the present invention that in continuous casting of ultra low carbon (ULC) steel that the combination to be utilized should be different than for other types of steel, the insulating properties of the mold fluxes being especially critical for ULC grade fluxes, and carbon pickup must be minimized, and that according to the invention spherical granules can be used for ULC steels even though the conventional wisdom is that granules do not insulate as well as powders and, therefore, are not suitable for use with ULC steels.

The basic granular mold flux of the invention comprising refractory metal oxide, one or more fluxing agents, a binder and an expanding agent, the expanding agent being present in an amount of 0.1% to 3% by weight based on the weight of the flux, preferably about 0.3 to 1%, and the granules are in spherical form. Spherical granules have the best properties in terms of chemical uniformity and cold flowability and also have suitable insulating ability. However, conventional spherical granules in the past have not been as forgiving in the mold as powders during turbulent conditions. During turbulent conditions the narrow face is particularly disturbed by rolling and level variation and spherical granules tend to run down toward the lower levels due to their good flowability. This can result in exposing liquid flux or even steel near the narrow face. However, because of the expanding agent according to the invention, as well as the reduced average particle size of the spheres, the permeability of the flux is reduced, thereby improving its insulating values, and the cold flowability is reduced, the net result being that the material can be used successfully during submerged entry shroud (SEN) and tundish changes without the tendency to form steel floaters.

According to one aspect of the present invention a mold flux is provided comprising refractory metal oxide, at least one fluxing agent, a binder, and expandable graphite, said expandable graphite having a size of less than about 80 mesh, and said flux in the form of spherical granules. The granules preferably have a size of 200–500 microns, which is a smaller range than for conventional spherical granules, and the expandable graphite comprises 0.3–1.0% by weight of the mold flux.

It is also highly desirable according to the invention to provide a soluble carbonate as a binder, preferably either sodium carbonate (soda ash) or lithium carbonate. At least 4% soda ash, or at least 2% lithium carbonate, or a combination of at least 2% soda ash and at least 1% lithium carbonate, are typically used. Most desirably the binder comprises between about 8–14% by weight soda ash, or between about 4–7% by weight lithium carbonate, or a combination of soda ash and lithium carbonate wherein double the percentage of lithium carbonate plus the percentage of soda ash is between about 8–14% by weight.

According to another aspect of the present invention a mold flux is provided containing the basic constituents as set forth above but also including starch in a sufficient amount so as to cause carbon black to migrate to the surface of the granules to improve efficiency of carbon black addition, reducing slag rim, improving thermal insulation, and reducing carbon pickup; and $MnO_2$ (oxidizing agent) in sufficient amount so as to oxidize carbon and reduce carbon pickup allowing higher carbon addition to the flux providing improved thermal insulation and less slag rim. The amount of starch is about 0.1 to 1.0% by weight, for example about 0.3 to 0.7% by weight, typically about 0.5% by weight, and the amount of $MnO_2$ is about 1 to 5% by weight, for example about 2 to 4% by weight, typically about 3% by weight.

According to a further feature of the invention there is provided a method of continuously casting molten steel in a mold the method comprising adding to the mold prior to, during or after teeming of the molten steel a spherical granular mold flux comprising at least one refractory metal oxide, at least one fluxing agent, a binder and an expanding agent, the expanding agent being present in an amount of 0.1% to 3%, preferably 0.3 to 1%, by weight based on the weight of the flux. That is, according to the invention a method of continuous casting molten ultra low carbon steel is provided using a casting mold, the method comprising the step of adding to the mold prior to, during, or after teeming of molten ultra low carbon steel a spherical granule mold flux comprising refractory metal oxide, at least one fluxing agent, a binder, and expandable graphite, starch in a sufficient amount so as to cause carbon black to migrate to the surface of the granules to improve efficiency of carbon black addition, reducing slag rim, improving thermal insulation, and reducing carbon pickup; and $MnO_2$ in sufficient amount so as to oxidize carbon and reduce carbon pickup allowing higher carbon addition to the flux providing improved thermal insulation and less slag rim.

It is the primary object of the present invention to provide for the continuous casting of molten steel utilizing a fluxing agent that has most of the advantages recognized for granular fluxes in the prior art, with fewer of the drawbacks, and is particularly well suited for continuous casting processes, including for ULC steel. This and other objects of the invention will become clear from a inspection of the detailed description of the invention and from the appended claims.

DETAILED DESCRIPTION

The manufacture of the spherical granules that yields the best results for fluxes in the continuous casting of steel is the utilization of acid treated graphite (or expandable perlite, or expandable vermiculite) of a size that is below about 80 mesh (177 microns), and to combine it with particular binders. If the graphite has a size above 80 mesh the graphite floats to the top of the slurry during manufacture—i.e. it does not mix well in the slurry, which typically contains about 60% solids. The granules are held together with soluble carbonate as a binder, either sodium carbonate (soda ash) or lithium carbonate. A minimum of 4% soda ash is used, or a minimum of 2% lithium carbonate, or a combination of at least 2% soda ash and at least 1% lithium carbonate; preferably 8–14% soda ash is used, or 4–7% lithium carbonate, or a combination of soda ash and lithium carbonate wherein double the percentage of lithium carbonate plus the percentage of soda ash is between about 8–14% by weight. For example one particularly desirable combination for the binder is about 10% soda ash, and about 1% lithium carbonate. This binding mechanism has proven more effective than using some organic binder in terms of granule strength, as well as absence of odor. The size of the granules produced by spray drying this composition is preferably about 0.2–0.5mm (200–500 microns), which is significantly smaller than average spherical granules (which includes spray dried and pan granulation granules), and even slightly smaller than conventional spray dried spherical granules.

The refractory metal oxide is preferably made up of calcium oxide and silica but alumina and/or magnesia may also be present. Materials such as blast furnace slag which contains calcium oxide, silica and alumina, or feldspar (sodium potassium aluminum silicate) which contains alumina and silica may be used as a source of refractory metal oxides.

Wollastonite, which contains calcium oxide and silica, is a particularly useful component since it is capable of absorbing appreciable amounts of alumina from the steel into the flux without significantly affecting the viscosity or melting point of the flux. The wollastonite component may be, for example, a synthetic or natural calcium monosilicate (which may contain very small quantities of iron oxide and/or alumina), or it may be calcium monosilicate in solid solution with at least one of silica, calcium oxide or alumina, for example, a solid solution containing pseudo-wollastonite or rankinite.

The fluxing agent may be, for example, one or more of sodium carbonate (soda ash), potassium carbonate, lithium carbonate, barium carbonate, sodium fluoride, aluminum fluoride, potassium fluoride, cryolite, fluorspar, manganese dioxide and olivine. The fluxing agent reduces the melting point of the flux and by the selection of particular fluxing agents and amounts the variation of the viscosity of the flux with temperature can be controlled. Lithium carbonate and soda ash may alternatively be used as the binder. The binder may be any suitable binder which will maintain the integrity of the granules from manufacture through storage, transport and use up to the point of expansion of the expanding agent when it is necessary for the granules to disintegrate back into the original powder form. Examples of suitable binders include resins, gums such as a polysaccharide gum and carbohydrate materials such as molasses, alternatively lithium carbonate and soda ash are preferred, as described above.

The expanding agent may be, instead of acid-heated graphite, expandable perlite or expandable vermiculite. The expanding agent is preferably present in an amount of 0.3% to 1.5%, most desirably 0.3–1%, by weight based on the weight of the flux, and is preferably expandable graphite.

The flux may also contain a light-weight refractory material such as expanded perlite, expanded vermiculite, or pumice, to lower the overall density of the flux.

The flux may also contain a carbonaceous material, (in addition to any expandable graphite which may be present as the expanding agent), such as charcoal, coke, anthracite, graphite or carbon black, to control the melting rate and sintering characteristics of the flux.

The flux will usually contain 45% to 90% refractory metal oxide, 10% to 50% by weight of fluxing agent, 2% to 14% by weight of binder, 0% to 10% by weight of light-weight refractory material, and 1% to 6% by weight of carbonaceous material other than expandable graphite.

The application rate of the mold flux to the mold will usually be in the range of 0.3 kg/ton to 1.1 kg/ton of steel cast, which is substantially the same as for conventional fluxes.

The spherical granules may be produced by a method such as pan granulation but they are preferably produced by spray drying an aqueous slurry of a mixture of the flux constituents, typically about 60% solids. The granules may be in a size range as broad as of from 0.1 mm to 1 mm in diameter, but preferably are 0.2–0.5 mm (200–500 microns) in diameter.

As stated previously the granular mold flux of the invention breaks down in contact with the steel in the mold producing a powder layer of flux on the surface and preventing exposure of the steel in the mold corners. Additionally the granular mold flux of the invention retains the advantages of known granular mold fluxes such as greater homogeneity compared with powder flux compositions, low dust production and excellent flowability for ease of automatic application.

The following examples will serve to illustrate the invention:

EXAMPLE 1

Substantially spherical granules of size 0.1 mm to 0.8 mm diameter were produced by spray drying an aqueous slurry having the following constituents:

| | % by weight |
|---|---|
| Sodium carbonate | 9.75 |
| Fluorspar | 21.56 |
| Calcium silicate | 37.99 |
| Expanded perlite | 4.11 |
| Graphite | 1.13 |
| Carbon black | 1.23 |
| Manganese dioxide | 7.70 |
| Sodium potassium aluminum silicate | 10.78 |
| Barium carbonate | 5.13 |
| Expandable graphite | 0.52 |
| Polysaccharide gum | 0.10 |

The granules were added to a mold in which steel slab was continuously cast at a temperature of 1520° C. at a rate of 0.6 kg/ton. The granules readily broke down to form a complete powder cover on the surface of the steel, and the slab produced was clean and defect free.

EXAMPLE 2

A granular mold flux (A) according to the invention was used in comparison with a granular mold flux (B) not according to the invention. The compositions, by weight, of the two fluxes were as follows:

| | (A) % | (B) % |
|---|---|---|
| Calcium silicate | 52.7 | 52.5 |
| Carbon black | 1.0 | 1.0 |
| Sodium fluoride | 10.0 | 10.0 |
| Calcium fluoride | 8.0 | 8.0 |
| Olivine | 6.0 | 6.0 |
| Feldspar | 7.8 | 7.8 |
| Alumina | 1.5 | 1.5 |
| Graphite | — | 1.0 |
| Lithium carbonate | 1.0 | 1.0 |
| Sodium carbonate | 11.2 | 11.1 |
| Polysaccharide gum | 0.1 | 0.1 |
| Expandable graphite | 0.7 | — |

Flux (B) was in regular use on a continuous casting plant and under most conditions provided excellent lubrication between the mold wall and the steel. However, in exceptional circumstances when, due to flushing of the tundish nozzle, a rapid steel level rise took place in the mold, inadequate lubrication was provided, and sticking of the cast steel to the mold sometimes occurred.

Modification of the flux composition as in flux (A), i.e. by replacing the 1% by weight graphite with 0.7% by weight expandable graphite and making up the balance with an additional 0.2% by weight of calcium silicate and 0.1% by weight of sodium carbonate gave an improvement in performance in that sticking did not occur during rapid rises of the steel in the mold. This improvement is believed to be attributable to flux (A) not running away so rapidly from the high spot and thus better maintaining the integrity of the lubricating layer of flux over the steel.

When the mold flux according to the invention is used for ultra low carbon (ULC) steel, different compositions are preferably utilized. The insulating properties of the mold fluxes are especially critical on ULC grades, and carbon pickup (usually achieved by lower free carbon additions) must be minimized (although this may reduce thermal insulation and increase slag rim formation). Since conventional granules do not insulate as well as powders, normally granules are not used with ULC steels. However, according to the invention granules can be used.

In the ULC steel formulations according to the present invention, a granular mold flux is provided which contains expanding agent, starch, and oxidizing agent; this improves thermal insulation, reduces carbon pickup, reduces slag rim, and improves the flexibility of the flux in turbulent conditions. As described earlier, the expanding agent—preferably expandable graphite—causes the flux to break down into powder, improving metal coverage during turbulent conditions as the "in mold" flowability of powder is less. The oxidizing agent—preferably $MnO_2$—is in sufficient amount so that it oxidizes the carbon and thereby reduces carbon pickup into the steel—thus allowing for higher carbon additions into the flux, giving improved thermal insulation and less slag rim (the amount of $MnO_2$ is about 1 to 5% by weight, typically 2.5% to 3.5% by weight). The starch is in sufficient amount so that it causes carbon black to migrate to the surface of the granules, thus improving efficiency of carbon black additions, hence further reducing slag rim, improving thermal insulation, and reducing carbon pickup in the steel (preferably the amount of starch is about 0.1% to 1% by weight, more preferably 0.4 to 0.7% by weight). For example, typical flux recipes for use with ULC steel (adding to the mold prior to, during, or after teeming of molten ULC steel) are set forth in Examples 3 and 4.

EXAMPLE 3

| | | % by weight |
|---|---|---|
| 1. | Calcium silicate | 21.5 |
| 2. | Carbon black | 0.8 |
| 3. | Blast furnace slag | 28.2 |
| 4. | Calcium fluoride | 12.3 |
| 5. | Olivine | 6.1 |
| 6. | Magnesite | 0 |
| 7. | Sodium potassium aluminum silicate | 11.8 |
| 8. | Starch | 0.5 |
| 9. | Manganese dioxide | 2.8 |
| 10. | Lithium carbonate | 1.2 |
| 11. | Sodium carbonate | 6.1 |
| 12. | Polysaccharide gum | 0.1 |
| 13. | Strontium carbonate | 7.6 |
| 14. | Expandable graphite | 1.0 |
| 15. | Soda lime glass | 0 |

EXAMPLE 4

| | | % by weight |
|---|---|---|
| 1. | Calcium silicate | 21.9 |
| 2. | Carbon black | 0.8 |
| 3. | Blast furnace slag | 31.4 |
| 4. | Calcium fluoride | 11.6 |
| 5. | Olivine | 0 |
| 6. | Magnesite | 2.4 |
| 7. | Sodium potassium aluminum silicate | 8.4 |
| 8. | Starch | 0.6 |
| 9. | Manganese dioxide | 3.6 |
| 10. | Lithium carbonate | 1.7 |
| 11. | Sodium carbonate | 3.4 |
| 12. | Polysaccharide gum | 0.1 |
| 13. | Strontium carbonate | 0 |
| 14. | Expandable graphite | 0.8 |
| 15. | Soda lime glass | 13.3 |

It will thus be seen that according to the present invention an advantageous mold flux, and method of continuously casting molten steel, have been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent fluxes and methods.

What is claimed is:

1. A mold flux comprising refractory metal oxide, at least one fluxing agent, a binder, and expandable graphite comprising 0.3–1.0% by weight of said mold flux, said flux in the form of spherical granules having a size of 200–500 microns.

2. A mold flux as recited in claim 1 wherein said binder comprises at least 4% soda ash, or at least 2% lithium carbonate, or a combination of at least 2% soda ash and at least 1% lithium carbonate.

3. A mold flux as recited in claim 1 including carbon black, and further comprising starch in a sufficient amount so as to cause carbon black to migrate to the surface of the granules to improve efficiency of carbon black addition, reducing slag rim, improving thermal insulation, and reducing carbon pickup; and $MnO_2$ in sufficient amount so as to oxidize carbon and reduce carbon pickup allowing higher carbon addition to the flux providing improved thermal insulation and less slag rim, in the production of ultra low carbon steel.

4. A mold flux as recited in claim 3 wherein the amount of starch is about 0.1to 1.0% by weight and the amount of $MnO_2$ is about 1 to 5% by weight.

5. A mold flux comprising refractory metal oxide, at least one fluxing agent, a binder, and expandable graphite, said expandable graphite having a size of less than about 80 mesh, and said flux in the form of spherical granules which have a size of 200–500 microns. and wherein said expandable graphite comprises 0.3–1.0% by weight of said mold flux.

6. A mold flux as recited in claim 1 wherein said binder comprises at least 4% soda ash, or at least 2% lithium carbonate, or a combination of at least 2% soda ash and at least 1% lithium carbonate.

7. A mold flux as recited in claim 1 wherein said flux contains, by weight, about 45–90% refractory metal oxide, 10–50% fluxing agent, 0–10% light weight refractory material, about 1–6% of a carbonaceous material other than expandable graphite, and about 0.3–1% expandable graphite.

8. A mold flux as recited in claim 1 including carbon black, and further comprising starch in a sufficient amount so as to cause carbon black to migrate to the surface of the granules to improve efficiency of carbon black addition, reducing slag rim, improving thermal insulation, and reducing carbon pickup; and $Mno_2$ in sufficient amount so as to oxidize carbon and reduce carbon pickup allowing higher carbon addition to the flux providing improved thermal insulation and less slag rim.

9. A mold flux as recited in claim 5 wherein the amount of starch is about 0.1 to 1.0% by weight, of the flux, and the amount of $MnO_2$ is about 1 to 5% by weight, of the flux.

10. A mold flux as recited in claim 8 wherein said binder comprises at least 4% soda ash, or at least 2% lithium carbonate, or a combination of at least 2% soda ash and at least 1% lithium carbonate.

11. A method of continuously casting molten ultra low carbon steel, using a casting mold comprising the step of:

adding to the mold after teeming of molten ultra low carbon steel a spherical granule mold flux comprising refractory metal oxide, at least one fluxing agent, including carbon black, a binder, and expandable graphite, starch in a sufficient amount so as to cause carbon black to migrate to the surface of the granules to improve efficiency of carbon black addition, reducing slag rim, improving thermal insulation, and reducing carbon pickup; and $MnO_2$ in sufficient amount so as to oxidize carbon and reduce carbon pickup allowing higher carbon addition to the flux providing improved thermal insulation and less slag rim.

12. A method as recited in claim 11 wherein said step of adding fluxing agent wherein the amount of starch is about 0.1 to 1.0% by weight and the amount of $MnO_2$ is about 1 to 5% by weight.

13. A mold flux comprising refractory metal oxide, at least one fluxing agent, a binder, and expandable graphite comprising 0.3–1.0% by weight of said mold flux, said flux in the form of spherical granules which have a size of 200–500 microns; and wherein said binder comprises at least 4% soda ash, or at least 2% lithium carbonate, or a combination of at least 2% soda ash and at least 1% lithium carbonate.

14. A mold flux as recited in claim 13 wherein said binder comprises between about 8–14% by weight soda ash, or between about 4–7% by weight lithium carbonate, or a combination of soda ash and lithium carbonate wherein double the percentage of lithium carbonate plus the percentage of soda ash is between about 8–14% by weight.

15. A mold flux as recited in claim 13 wherein said flux contains, by weight, about 45–90% refractory metal oxide, 10–50% fluxing agent, 0–10% light weight refractory material, about 1–6% of a carbonaceous material other than expandable graphite, and about 0.3–1% expandable graphite.

16. A mold flux comprising refractory metal oxide, at least one fluxing agent in the form of spherical granules having a size of 200–500 microns, a binder, expandable graphite in an amount of about 0.3–1% by weight, starch in an amount of about 0.1 to 1.0% by weight and $MnO_2$ in an amount of about 1 to 5% by weight.

* * * * *

UNITED STATES PATENT AND TRADEMARK OFFICE

CERTIFICATE OF CORRECTION

PATENT NO. : 5,577,549
DATED : November 26, 1996
INVENTOR(S) : R.J. PHILLIPS et al It is certified that error appears in the above-indentified patent and that said Letters Patent is hereby corrected as shown below:

Claim 6, line 1, replace "1" with -- 5 --.

Claim 7, line 1, replace "1" with -- 5 --.

Claim 8, line 1, replace "1" with -- 5 --.

Claim 9, line 1, replace "5" with -- 8 --.

Signed and Sealed this

Eleventh Day of November, 1997

*Attest:*

Bruce Lehman

BRUCE LEHMAN

*Attesting Officer*

*Commissioner of Patents and Trademarks*